US006583694B2

(12) United States Patent
Comtois et al.

(10) Patent No.: US 6,583,694 B2
(45) Date of Patent: Jun. 24, 2003

(54) INTERRUPTING SUBASSEMBLY FOR SWITCHING APPLIANCE

(75) Inventors: Patrick Comtois, Dijon (FR); Patrick Larcher, Ahuy (FR); Alain Moreux, Dijon (FR); Régis Perrocheau, Couternon (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/168,495

(22) PCT Filed: Feb. 16, 2001

(86) PCT No.: PCT/FR01/00467

§ 371 (c)(1),
(2), (4) Date: Jun. 21, 2002

(87) PCT Pub. No.: WO01/61717

PCT Pub. Date: Aug. 23, 2001

(65) Prior Publication Data

US 2003/0001700 A1 Jan. 2, 2003

(30) Foreign Application Priority Data

Feb. 18, 2000 (FR) ..... 00 02142

(51) Int. Cl.[7] ..... H01H 67/02
(52) U.S. Cl. ..... 335/106; 335/127; 335/129
(58) Field of Search ..... 335/78, 106, 127–135

(56) References Cited

U.S. PATENT DOCUMENTS 3,509,502 A * 4/1970 Maynard et al. ..... 335/129

FOREIGN PATENT DOCUMENTS

| | | |
|---|---|---|
| DE | 1 107 771 | 5/1961 |
| DE | 1 254 737 | 11/1967 |
| FR | 2 261 610 | 9/1975 |
| FR | 0 519 186 | 7/1983 |

* cited by examiner

*Primary Examiner*—Ramon M. Barrera
(74) *Attorney, Agent, or Firm*—Parkhurst & Wendel. L.L.P.

(57) ABSTRACT

The invention concerns a switching appliance comprising several main dual cut-out poles provided with fixed contacts housed in an arc box and mobile contacts located on a mobile contact-holder (30). The latter is equipped, for the main contacts, with main housings (31) aligned transversely to the direction (X) of displacement of the contact-holder (30), and, for the auxiliary contacts, secondary housings (32) aligned transversely to the direction (X) and located in front of the main housings (31). The contact-holder comprises between the main housings and the secondary housings a vertical insulating wall (35). The arc box consists of two half boxes (20, 40) assembled in a horizontal plane, so that one of the two halves provides guiding elements and stop elements for the contact-holder (30).

4 Claims, 2 Drawing Sheets

INTERRUPTING SUBASSEMBLY FOR SWITCHING APPLIANCE

FIELD OF THE INVENTION

The present invention relates to a multi-pole electromechanical switching device comprising principal contacts and auxiliary contacts housed in an arcing chamber, a contact carrier mobile in translation within the arcing chamber and carrying auxiliary housings for auxiliary contacts located in front of the principal housings for the principal contacts.

DESCRIPTION OF THE RELATED ART

In switching devices, the mobile contact carrier, which holds the mobile contacts, moves in translation from the front to the rear inside the arcing chamber in such a way as to be able to separate or place these mobile contacts on the fixed contacts located on the arcing chamber. In general, when the housings of the auxiliary contacts are located next to the housings of the principal contacts following the same vertical plane, the insulation between principal and auxiliary housings can be ensured by a longitudinal wall, parallel to the direction of movement of the contact carrier, for example of the same type as the inter-pole walls of the principal housings. This wall can thus be easily produced in the contact carrier or in the arcing chamber, without hindering the movement of the contact carrier. However, when the vertical plane of the auxiliary contact housings is different, for example in front of the vertical plane of the principal contact housings, the insulation between principal and auxiliary housings must be ensured by a wall which is transversal (or perpendicular) to the movement of the mobile contact carrier, and which can hinder the translation movement if one wishes to keep the switching device small in size.

The aim of the invention is therefore to create a method for simple and compact insulation between the housings of the principal contacts and the housings of the auxiliary contacts, when these housings are in different vertical planes, without adding any supplementary part and still maintaining easy integration of the contact carrier into the arcing chamber during manufacture of the switching device.

SUMMARY OF THE INVENTION

According to the invention, the contact carriers comprise auxiliary housings for auxiliary contacts, these auxiliary housings being aligned transversally to the direction of displacement of the contact carrier and located in front of the principal housings of the principal contacts. Between the principal housings and the auxiliary housings, the contact carrier comprises a vertical insulating wall composed of several polar insulating side walls separated by inter-pole slits. In order to be able to insert the contact carrier easily into the arcing chamber, the latter is composed of two half-chambers assembled by interlocking and/or mutual clipping along a horizontal plane, such that at least one of the two halves has guide elements for the contact carrier and stop elements for it. Furthermore, each half of the arcing chamber comprises an insulating partition between principal contacts and auxiliary contacts.

BRIEF DESCRIPTION OF THE DRAWINGS

The description below of a preferred embodiment according to the invention is given as a non-limitative example, with reference to the attached diagrams.

DESCRIPTION OF THE PREFERRED EMBODIMENT

Figure 1:
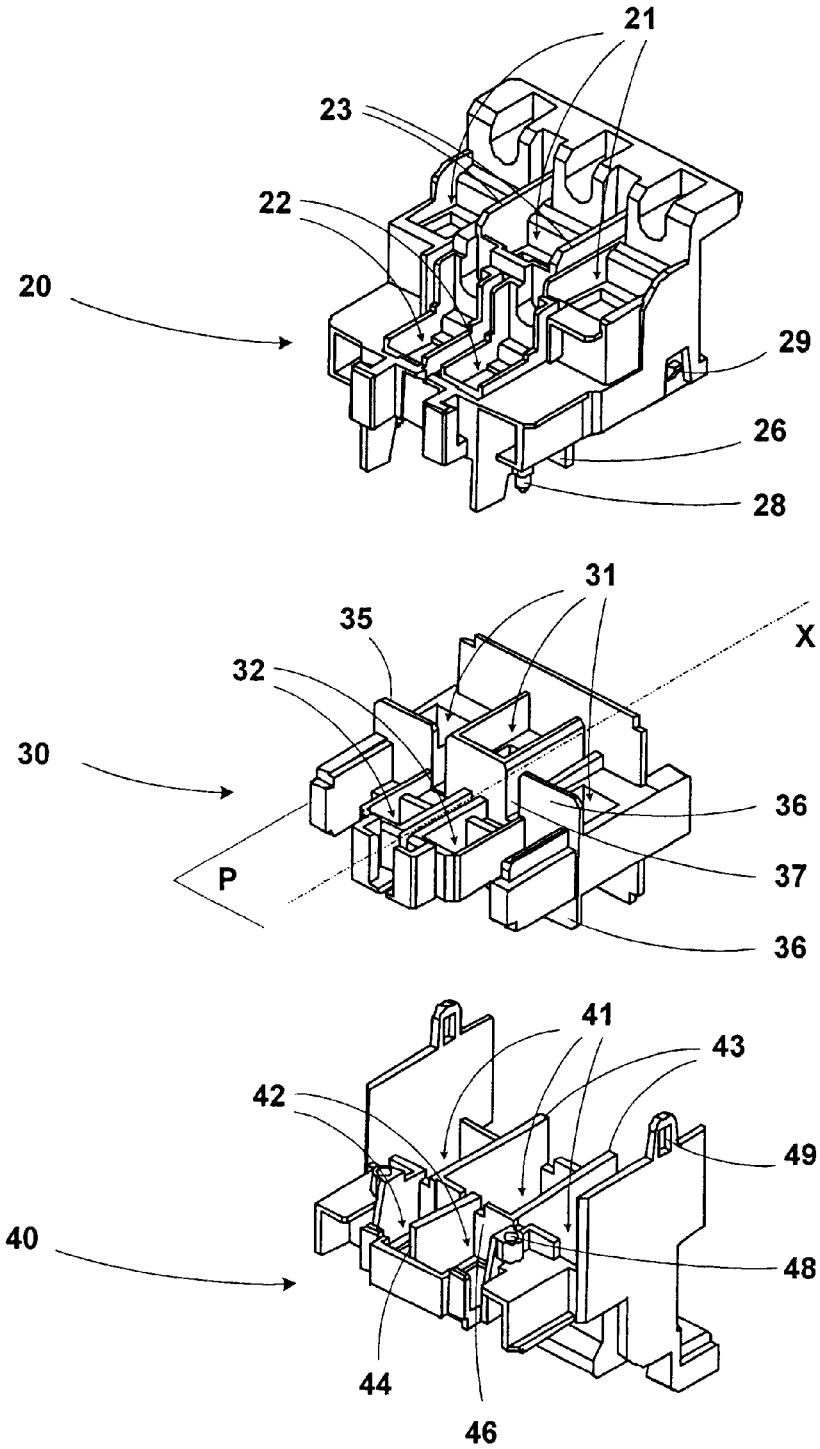
FIG. 1 shows a view in perspective of the contact carrier of a switching device, surrounded by two halves of the arcing chamber, without representing the contacts.
Figure 2:
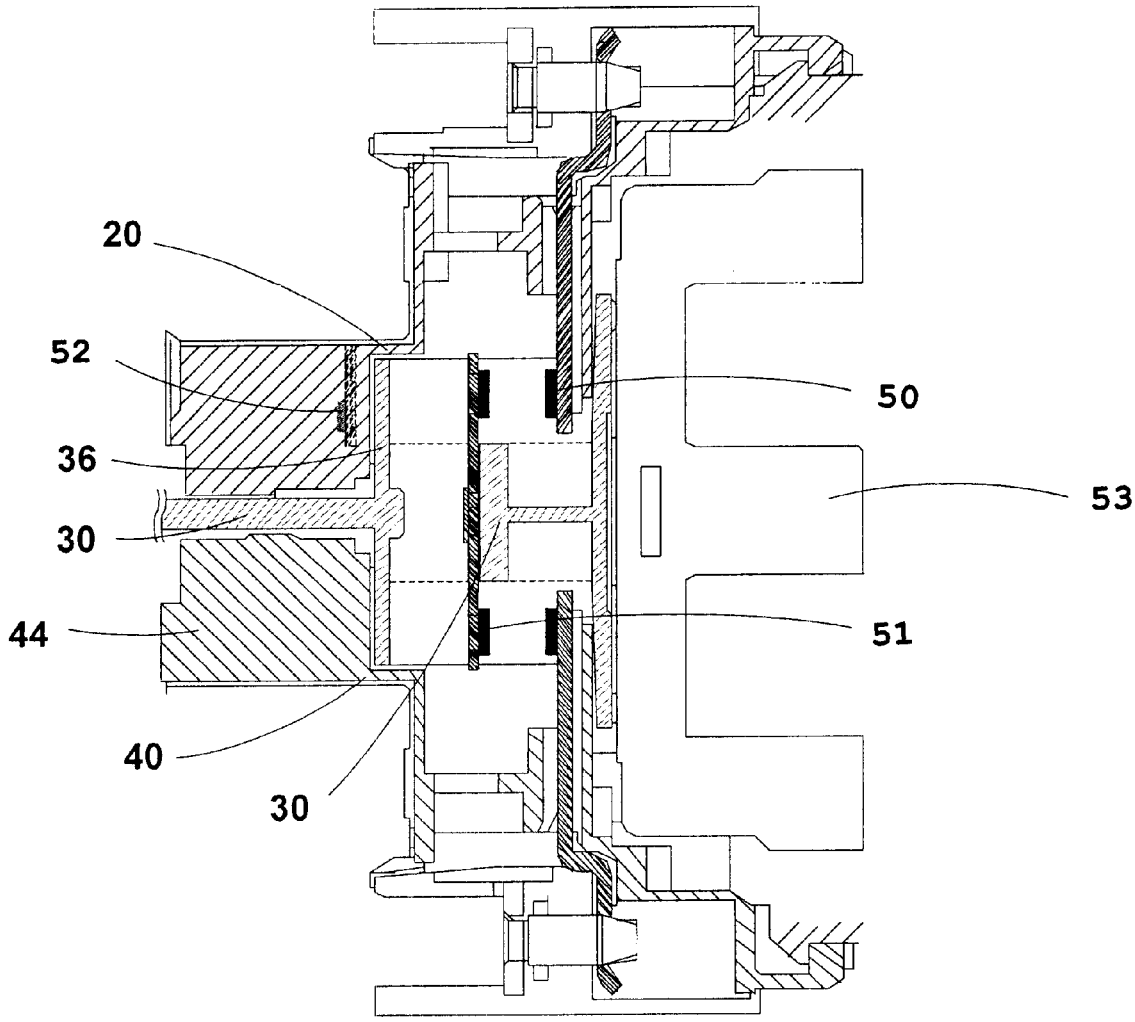
FIG. 2 shows a vertical cross-section of the contact carrier of the switching device shown in FIG. 1, surrounded by two halves of the arcing chamber, according to the present invention.

The switching device described in the embodiment diagrams of FIGS. 1 and 2 comprises, inside an insulating body, three principal poles with double switching and two auxiliary poles. The principal poles are each provided with two fixed contacts 50 located in an arcing chamber 20, 40. The fixed contacts 50, shown in FIG. 2, are lodged in the principal chambers 21, 41 of the arcing chamber. The principal poles are also provided with two mobile contacts 51, each shown in FIG. 2, fixed in the principal housings 31 of a mobile contact carrier 30. In the same way, the different auxiliary poles are provided with fixed contacts 50 located in the auxiliary chambers 22, 42 of the arcing chamber 20, 40, and mobile contacts 51 set in the auxiliary housings 32 of the contact carrier 30. Inside the arcing chamber 20, 40, the contact carrier 30 is mobile in translation along a horizontal axis X, ensuring the separation or the contacting of the mobile contacts 51 on the fixed contacts 50. Electromagnet 53 for translating mobile contacts 51 is shown in FIG. 2.

The principal housings 31 are aligned transversally to the displacement direction X of the contact carrier 30 and are located in a vertical plane distinct from that of the auxiliary housings 32, also being aligned transversally to the direction X. In the whole of the description, this horizontal axis X corresponds to a direction called front/rear of the switching device, the front side of the device being the side of the auxiliary housings 32 and the rear side of the device being the side of the principal housings 31. The contact carrier 30 is integral with the mobile part of an electromagnet located at the rear of the device and whose displacement is provoked by circulating a current in a winding of the electromagnet.

Between the principal housings 31 and the auxiliary housings 32, the arcing chamber 30 comprises a vertical insulating wall 35 intended to contribute to the insulation between the principal housings 31 and the auxiliary housings 32. This wall is transversal relative to the axis X and is composed of several polar insulation side walls 36, separated by inter-pole slits 37. By ensuring efficient insulation with low dimensions, it enables the contact carrier to keep to a compact size.

Given the dimension of the insulating vertical wall 35, it would be difficult to insert the contact carrier 30 directly into the arcing chamber during manufacture of the switching device. This is why the arcing chamber is constituted of two half-chambers: an upper half 20 and a lower half 40, assembled by interlocking and/or mutual clipping along a horizontal plane which can be the horizontal median plane P of the contact carrier 30 or a plane parallel to P. This assembly is, for example, carried out with clipping means 49 on the lower half 40 co-operating with complementary clipping means 29 on the upper half 20. Furthermore, interlocking means 48 on the lower half 40 co-operate with complementary interlocking means 28 on the upper half 20 to ensure better guiding and better fixing together of the two halves 20, 40 of the arcing chamber.

Thus, during manufacture of the switching device, it becomes easy to assemble the arcing chamber by first of all positioning the contact carrier 30 on the lower half 40, for example, and then interlocking the upper half 20 above. The contact carrier 30 is symmetrical around its horizontal median plane P and the two halves of the arcing chamber are set on either side, in closely symmetrical manner relative to this plane P.

Once assembled, the two halves 20, 40 of the arcing chamber allow the contact carrier 30 to slide only along the horizontal axis X because of the guide elements present on at least one of the two halves 20, 40. These guide elements comprise, for example on the lower half 40, two principal inter-pole separations 43 between the three principal chamber 41 and an auxiliary inter-pole separation 44 between the two auxiliary chambers 42. On the upper half 20, these guide elements can also comprise two principal inter-pole separations 23 between the three principal chambers 21. These separations co-operate with elements of complementary shape located between the principal housings 31 and between the auxiliary housings 32 of the contact carrier 30. Furthermore, the principal inter-pole separations 23, 43 are inserted into the inter-pole slits 37 of the insulating wall 35 in such a way as to avoid hindering the sliding movement of the contact carrier.

Each half of the arcing chamber 20, 40 also comprises an insulating partition 26, 46 between the principal chambers 21, 41 of the principal contacts and the auxiliary chambers 22, 42 of the auxiliary contacts 52, shown in FIG. 2. Apart from their contribution to the insulation between the two chambers, the insulating partitions 26, 46, define a front stop for the insulating side walls 36 of the insulating wall 35 thus limiting the run of the contact carrier 30.

What is claimed is:

1. A multi-pole electromechanical switching device having opposing front and rear ends, comprising several principal double switching poles each provided with fixed contacts housed in an arcing chamber and mobile contacts located on a contact carrier that is mobile in translation inside the arcing chamber responsive to attraction of an electromagnet located at the rear end of the device, the switching device further comprising principal housings for the principal mobile contacts of the principal poles, said principal housings aligned transversally to a direction of displacement of the contact carrier and separated by principal inter-pole separations of the arcing chamber, wherein:

the contact carrier comprises auxiliary housings for auxiliary contacts, said auxiliary housings aligned transversally to the direction of displacement of the contact carrier and located in front of the principal housings, the contact carrier comprises, between the principal housings and auxiliary housings, a vertical insulating wall comprising several polar insulating side walls separated by inter-pole slits, the arcing chamber comprises two half-chambers assembled by interlocking and/or mutual clipping along a horizontal plane, such that at least one of said two half-chambers comprises guide elements and stop elements for cooperating with the contact carrier, and each said half-chamber comprises an insulating partition located between principal contacts and auxiliary contacts.

2. The switching device according to claim 1, wherein the insulating partitions on the two halves of the arcing chamber define a stop for the insulating side walls of the insulating wall of the contact carrier.

3. The switching device according to claim 1, wherein the contact carrier defines a horizontal median plane of symmetry and the two halves of the arcing chamber are located substantially symmetrically relative to said plane of symmetry.

4. The switching device according to claim 1, wherein the guide elements of the contact carrier comprise the principal inter-pole separations of the arcing chamber, said inter-pole separations located in the inter-pole slits of the insulating wall of the contact carrier.

* * * * *